US006126216A

United States Patent [19]

Tollefson

[11] Patent Number: 6,126,216

[45] Date of Patent: Oct. 3, 2000

[54] BUCKET ATTACHMENT FOR LOG GRAPPLE

[76] Inventor: James S. Tollefson, Rte. 2, Box 921, L'Anse, Mich. 49946

[21] Appl. No.: 09/452,212

[22] Filed: Dec. 1, 1999

[51] Int. Cl.[7] ..... B66C 3/02

[52] U.S. Cl. ..... 294/2; 37/406; 37/903

[58] Field of Search ..... 294/2, 3, 68.23, 294/86.41, 88, 106, 902; 37/184, 186, 187, 403, 405, 406, 461, 903; 414/724, 607, 723, 912

[56] References Cited

U.S. PATENT DOCUMENTS

| | | | |
|---|---|---|---|
| 2,810,969 | 10/1957 | Harris | 294/2 X |
| 3,920,137 | 11/1975 | McCain | 294/68.23 X |
| 4,012,069 | 3/1977 | Carson | 294/68.23 |
| 4,542,929 | 9/1985 | Possinger | 294/68.23 X |
| 4,545,721 | 10/1985 | Petterson . | |
| 4,907,356 | 3/1990 | Labounty . | |
| 5,024,397 | 6/1991 | Edwards et al. . | |
| 5,472,249 | 12/1995 | Fiedler . | |

*Primary Examiner*—Johnny D. Cherry
*Attorney, Agent, or Firm*—Andrus, Sceales, Starke & Sawall, LLP

[57] ABSTRACT

A bucket is attachable to a tined jaw of a grapple on the boom of a mobile machine. The bucket includes a pair of opposed, parallel side plates, each of the side plates having a linear front edge, a linear top edge and an arcuate rear edge having a recess formed therethrough. Intermediate structure interconnects the side plates and includes an arcuate top wall running rearwardly and upwardly along a curved path spaced from the rear edge from a linear forward edge commencing beneath the front edge to a linear back edge. The top wall is constructed and arranged to extend over upper and lower portions of the jaw. A pair of connecting pins is provided, each of which is receivable in one of the side plate recesses and a through hole formed in an upper portion of the jaw.

10 Claims, 6 Drawing Sheets

BUCKET ATTACHMENT FOR LOG GRAPPLE

FIELD OF THE INVENTION

This invention relates generally to material handling and, more particularly, pertains to the conversion of a grapple assembly, such as used in log loading, to a dual bucket arrangement, such as used for handling dirt or other bulk materials.

BACKGROUND AND SUMMARY OF THE INVENTION

It is well known in the art of woodland harvesting to use work heads having jaw-like, hydraulic grapple assemblies that are movably connected to the booms of mobile power machines to handle and lift logs during deforestation. Typically, a hydraulically powered processing unit is employed in a woodland harvesting operation to sever and/or strip trees. Once the trees have been cut and lie on the ground, a separate mobile power unit such as a truck-mounted rig equipped with openable and closeable tines or jaws of the hydraulic grapple assembly is utilized to grasp and load the logs onto a pile or into a truck. The hydraulic grapple assembly is normally effective in moving the logs from one location to another. The grapple assembly is also used to clear the ground of other debris such as rocks and boulders from a particular site. However, because of its spaced apart, jaw-like construction, the grapple assembly is generally inefficient in the pick-up and transfer of extant bulk material such as dirt, gravel, sand, or wood chips.

Ideally, it would be more effective to use a scoop or bucket arrangement to load the bulk material. Unfortunately, this requires a separate vehicle such as an excavator to carry the bucket arrangement. Since it is expensive to have a separate vehicle to load bulk material, it would be advantageous if one could quickly and securely attach a scoop or bucket arrangement to the existing grapple assembly. In this manner, the operator of the mobile power machine would be able to selectively use the work head to grab logs and other large objects with the grapple assembly or scoop up material with the scoop or bucket arrangement.

Despite several attempts of the prior art to adapt a bulk handling device to a work head of a material handling machine by using various socket and/or connector structure, it remains desirable to provide an easy and secure means of mounting a scoop or bucket attachment to an existing grapple assembly such as used in log loading.

It is one object of the present invention to enable an operator of a log grapple assembly to mount a bucket arrangement on a boom assembly without removing the grapple assembly.

It is also an object of the present invention to fix a bucket attachment on an existing log grapple assembly in a manner such that the attachment is prevented from moving rearwardly, forwardly and laterally with respect to the grapple assembly.

It is a further object of the present invention to provide a grapple bucket attachment that requires a minimum modification to the existing grapple structure.

Still a further object of the present invention is to provide a grapple bucket attachment which is secured and operated using the motion control of the existing grapple structure.

This invention advantageously provides a modification of a grapple assembly with a bucket attachment when it is desired to extend the capability of an application from handling large objects to excavating and picking up fine materials.

In one aspect of the invention, a bucket is attachable to a tined jaw of a grapple on the boom of a mobile machine. The bucket includes a pair of opposed, parallel side plates, each of the side plates having a linear front edge, a linear top edge and an arcuate rear edge having a recess formed therethough. Intermediate structure connects the side plates and includes an arcuate top wall running rearwardly and upwardly along a curved path spaced from the rear edge from a linear forward edge commencing beneath the front edge to a linear back edge. The top wall is constructed and arranged to extend over upper and lower portions of the jaw. A pair of connecting pins is provided, each of which is receivable in one of the side plate recesses and a through hole formed in an upper portion of the jaw. The side plates are generally coextensive with one another, and the top wall is configured to correspond to the shape of the jaw. The linear forward edge is provided with a cutting edge used to penetrate particulate matter. The intermediate structure enables centering of the jaw between the side plates.

In another aspect of the invention, an implement is attachable to a boom structure of a mobile machine. The implement includes a grapple assembly having a pair of fork side and clam side jaws pivotally mounted on parallel axes. Each jaw has a pair of parallel, spaced apart tines formed with curved upper and lower surfaces. A bucket attachment is removably secured on the jaws and includes a fork side bucket and clam side bucket. The fork side bucket has a pair of opposed end plates with arcuate rear edges. The end plates are interconnected by a fork side intermediate structure provided with an arcuate bottom wall and an arcuate top wall. Both the bottom wall and the top wall are integrally formed together along respective linear forward edges. The bottom wall runs rearwardly, downwardly and upwardly partially along the curvature of the rear edge and terminates in a linear back edge. The top wall runs rearwardly and upwardly in spaced relationship to the bottom wall and terminates in a linear back edge above the bottom wall back edge. The bottom wall and top wall form a cavity for encasing the lower half of the fork side tines. The clam side bucket also has a pair of opposed end plates with arcuate edges. The end plates are connected together by a clam side intermediate structure provided with an arcuate bottom wall, an arcuate top wall and a generally upright back wall. Each of the bottom wall, the top wall and the back wall is centrally relieved to receive clam side tines therebetween. The bottom wall has spaced apart, side sections extending inwardly from inside surfaces of its side plates. Each side section runs rearwardly, downwardly and upwardly along an arcuate path spaced above the rear edges from a linear forward edge to a linear back edge. The top wall has a central planar section running rearwardly and upwardly from a linear forward edge joined to linear forward edges of bottom wall side sections and terminates in a linear back edge. The back wall has spaced apart, flanking portions extending inwardly from inside surfaces of the side plates, and a bottom edge connecting the flanking portions. Each of the bottom wall, top wall and back wall defines inside edges for guiding outer sides of the clam side tines. A connector arrangement is provided for coupling each fork side and clam side bucket to a respective fork side and clam side tine. The fork side intermediate structure and the clam side intermediate structure cooperate to enable the respective buckets to close upon each other to hold particulate material therein.

The present invention also contemplates a grapple assembly having a pair of fork side jaws provided with a pair of fork side buckets, and a grapple assembly having a pair of clam side jaws provided with a pair of clam side buckets.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
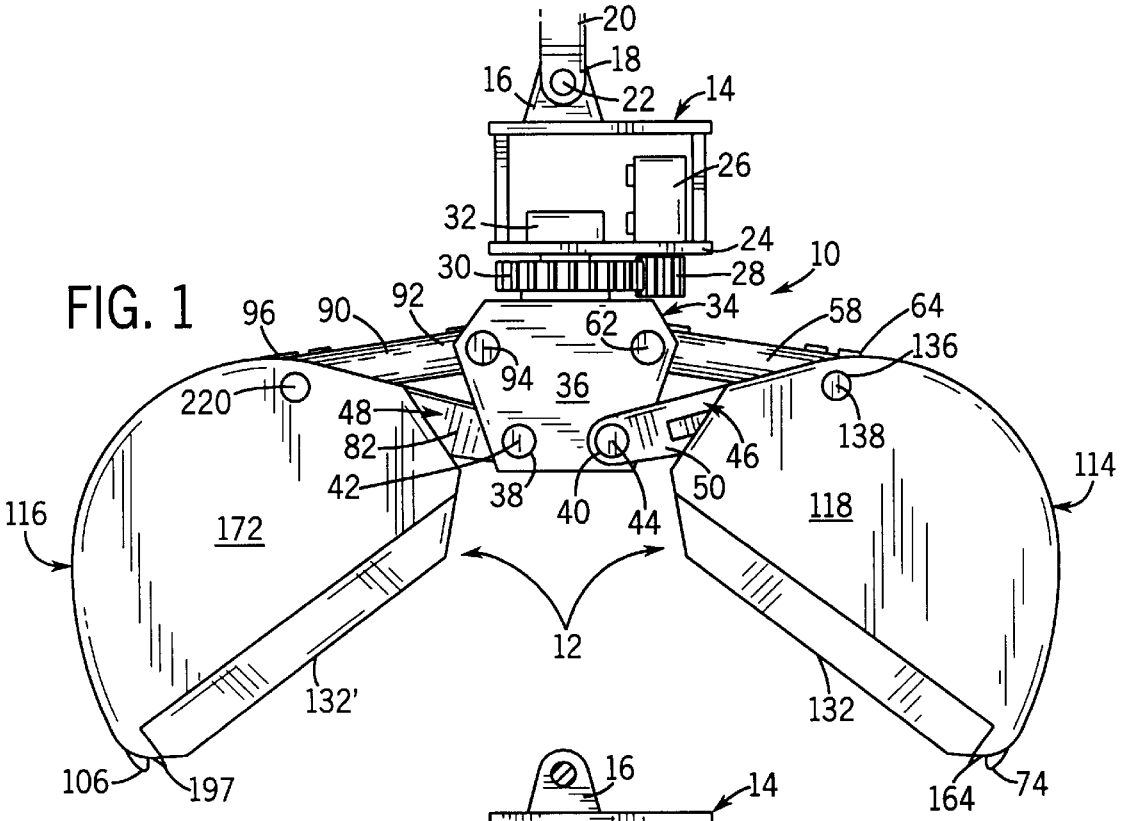
FIG. 1 is a front elevational view of a bypass grapple assembly equipped with a bucket attachment embodying the present invention and shown in an open position.
Figure 2:
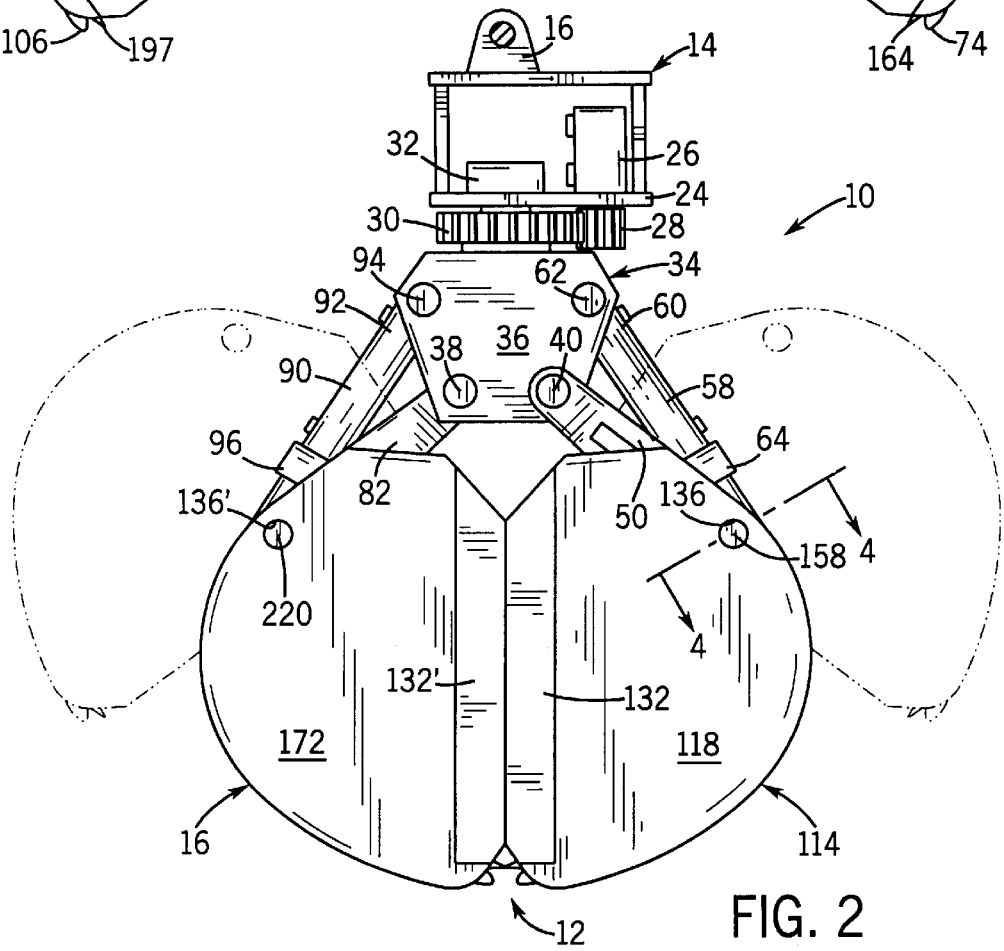
FIG. 2 is a view similar to FIG. 1, and showing the bucket arrangement on the grapple assembly in a closed position.
Figure 3:
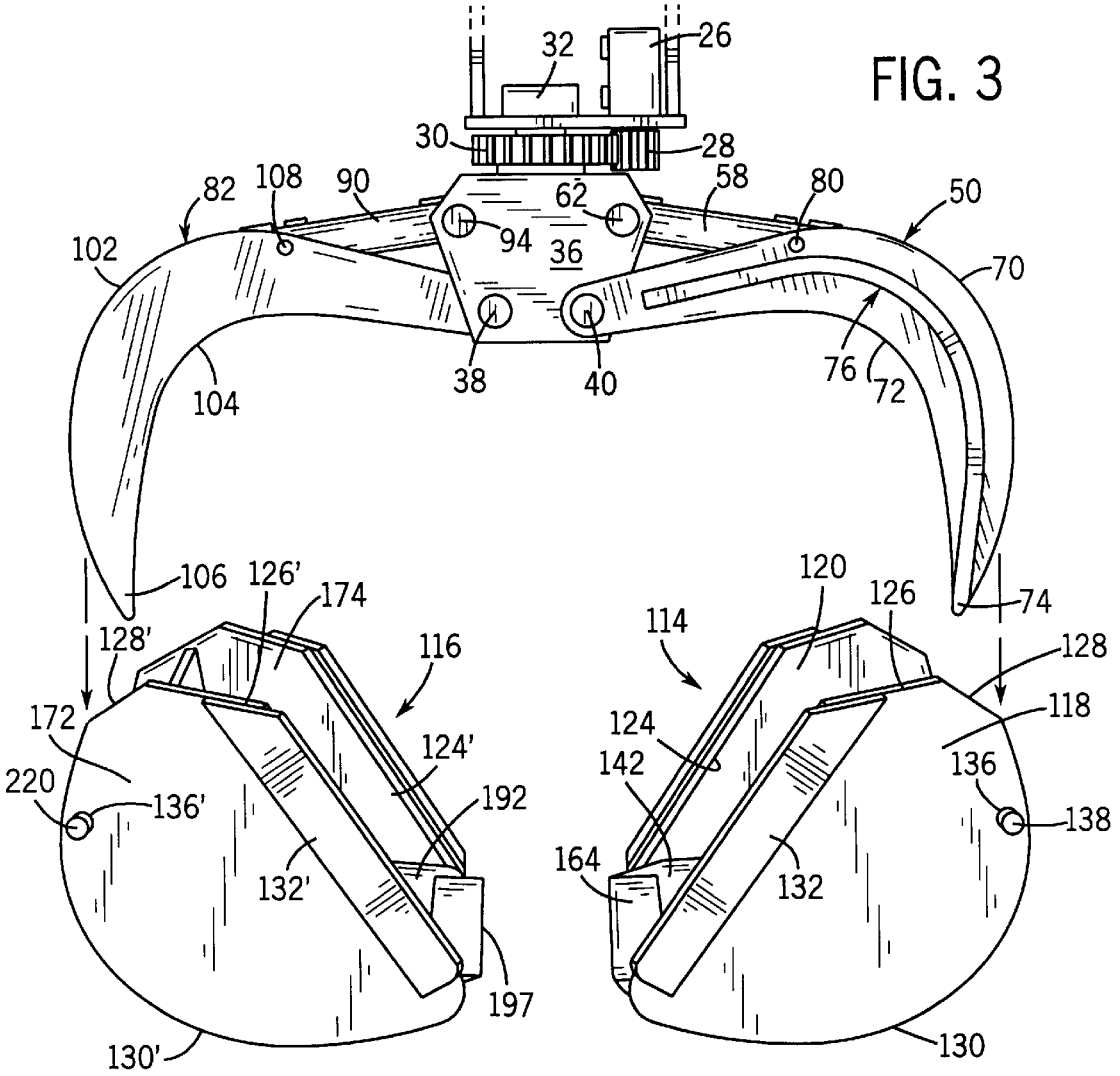
FIG. 3 is a front perspective view showing the manner in which facing fork side and clam side buckets of the bucket attachment are to be installed on the grapple assembly.

Referring now to FIGS. 1–3, the numeral 10 generally designates a grapple assembly 10 modified with a bucket attachment 12 in accordance with the present invention. The grapple assembly 10 is rotatably supported from a head connector 14 having an upstanding lug 16 which is received in a bifurcated end 18 of a mobile power machine boom 20. The head connector 14 is swingably attached to the boom 20 by means of a pivot pin 22 passing through aligned holes in the lugs 16 and the boom end 18. Although not shown, a hydraulic cylinder is generally mounted between the boom 20 and head connector 14 in order to pivot the head connector 14 and its attached grapple assembly 10 relative to the boom 20. The head connector 14 includes a housing 24 having a hydraulic motor 26 for rotating a pinion 28 depending therefrom. The pinion 28 is in meshing engagement with a gear wheel 30 rotatably attached to the bottom of a bearing assembly 32, also supported in the housing 24 adjacent the hydraulic motor 26. The grapple assembly 10 includes a head unit 34 mounted for rotation with the gear wheel 30 and comprising a pair of spaced apart, vertically disposed, mounting plates 36 (only one of which is shown), which are adapted to rotate about a vertical axis passing through the bearing assembly 32. The mounting plates 36 are formed with a pair of lower apertures 38,40 receiving respective pivot pins 42,44 used to rotatably secure the upper ends of a fork side jaw 48 and a clam side jaw 46, respectively.

Figure 4:
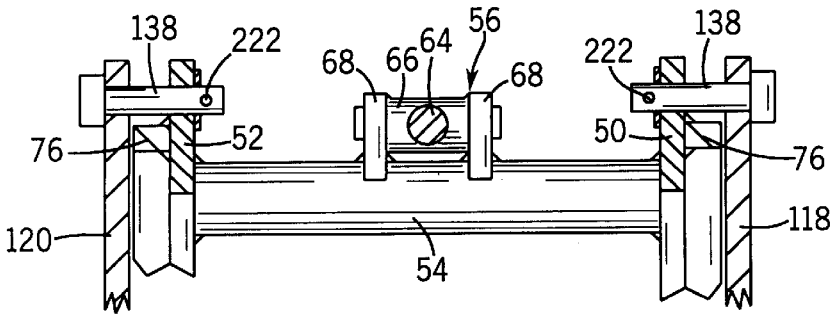
FIG. 4 is a partial sectional view taken on line 4—4 of FIG. 2.
Figure 6:
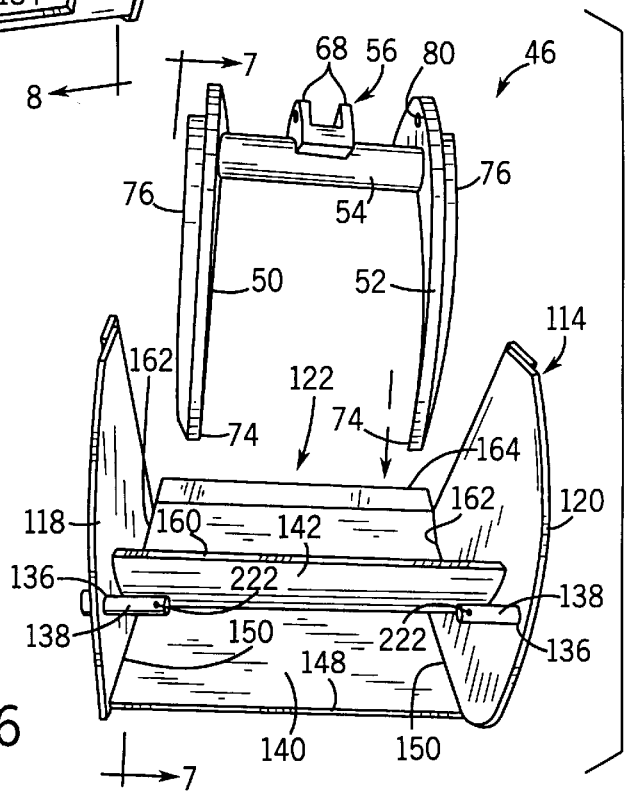
FIG. 6 is a partial elevational view taken from the right side of FIG. 3.

As seen in FIGS. 4 and 6, fork side jaw 46 is defined by a pair of parallel tines 50,52, the upper ends of which are connected together by a first cylindrical spacing member 54 to which a first saddle bracket 56 is welded. A first double acting, hydraulic cylinder 58 (FIGS. 2, 3) has a casing end 60 which is pivotably connected to a pivot pin 62 secured intermediate the fork side upper portions of mounting plates 36. The hydraulic cylinder 58 also has a rod end 64 which is secured to a horizontally disposed pin 66 fixed between upstanding ears 68 of saddle bracket 56. Each of the fork side tines 50,52 has a similar concave-convex shape having an upper edge 70, a lower edge 72 and a distal tip 74 opposite its upper end. In addition, a curved reinforcing bar 76 projects laterally from an outside face of each tine 50,52 and extends substantially along a center line thereof from an upper end to its distal tip 74. Besides adding rigidity to each tine 50,52, each reinforcing bar 76 provides an important spacing function in the installation of the bucket attachment 12, as will be appreciated hereafter. Furthermore, the upper sectors of the fork side tines 50,52 between the upper edges 70 and the reinforcing bars 76 are formed with aligned through holes 80 which will be understood to facilitate the mounting of the bucket attachment 12.

Figure 5:
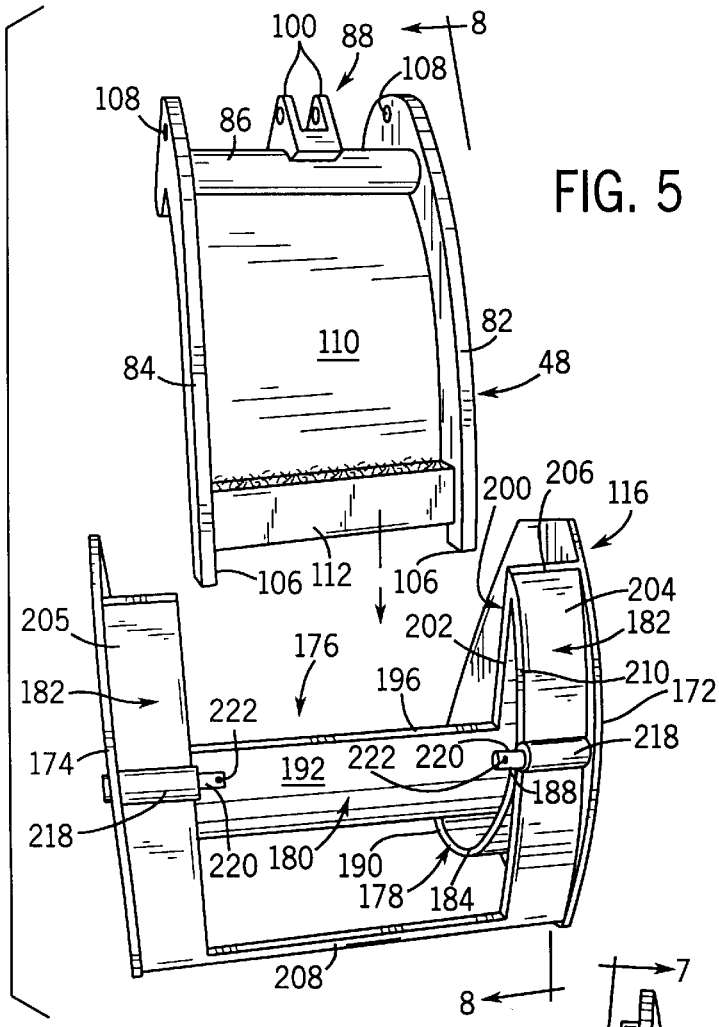
FIG. 5 is a partial elevational view taken from the left side of FIG. 3.

Referring now to FIG. 5, clam side jaw 48 is also defined by a pair of parallel tines 82,84, the upper ends of which are joined together by a second cylindrical spacing member 86 to which a second saddle bracket 88 is welded. As will be described below, the spacing between the clam side tines 82,84 is less than the spacing between the fork side tines 50,52. A second double acting, hydraulic cylinder 90 (FIGS. 2, 3) has a casing end 92 which is pivotably attached to a pivot pin 94 secured intermediate the clam side upper portions of mounting plates 36. The hydraulic cylinder 90 has a rod end 96 which is connected to another horizontally disposed anchor pin (not shown) fixed between upstanding ears 100 of saddle bracket 88. The clam side tines 82,84 are also formed with concave-convex shapes, similar to fork side tines 50,52 and include upper edges 102, lower edges 104, distal tips 106 and aligned through holes 108. Unlike fork side jaw 46, the clam side jaw 48 includes a curved wall 110 which extends between the tines 82,84 from the cylindrical spacing member 86 to the lower ends of the tines 82,84. A horizontal reinforcing plate 112 is welded to the base of curved wall 110 to enhance the rigidity thereof.

It is important to note that in this particular grapple assembly, the clam side jaw 48 is designed to pass by or between the tines 50,52 of the fork side jaw 46. Thus, the fork side jaw 46 and clam side jaw 48 can be said to form a bypass-type grapple assembly 10 which is particularly useful in woodland harvesting. As is well known, the hydraulic cylinders 58,90 permit an operator of the mobile power machine to hydraulically control opening and closing of the fork side and the clam side jaws 46,48 respectively, using a set of hydraulic controls (not shown). That is, extension and retraction of the cylinders 58,90 causes the pivoting of the fork side jaw and clam side jaws 46,48, respectively, about lower pivot pins 42,44 so as to enable selective grasping and releasing of logs and other large objects such as rocks or boulders. While it is generally effective in the engagement and transfer of larger objects, the grapple assembly 10 described above, is unsuitable in the handling of bulk and particulate materials, such as dirt, gravel, sand, wood chips, and the like. It is this shortcoming that the present invention addresses by providing a bulk material bucket attachment 12 having unique mounting characteristics.

According to the invention, the bucket attachment 12 is constructed and arranged with intermediate structure which connects the sides of a bucket, forms a particular material holding base and provides centering and guidance for grapple tines 50,52,82,84 as they are installed relative to the bucket attachment 12.

Bucket attachment 12 is comprised of a pair of cooperating buckets 114,116, one being removably mounted on the fork side jaw 46 and the other being removably mounted on the clam side jaw 48. Fork side bucket 114 includes a pair of parallel, opposed side plates 118,120 integrally joined together by a fork side intermediate structure 122. As seen in FIG. 3, each side plate 118,120 has an upwardly angled, linear front edge 124, a top edge having an upwardly ascending, linear portion 126, a downwardly descending, linear portion 128, and an arcuately shaped rear edge 130. Each of a pair of reinforcing straps 132 is welded to an outside surface of the side plates 118,120 along the entire angled front edges 124 and part of the upwardly ascending portions 126 of the top edges. The side plates 118,120 are also provided with a pair of aligned recesses 136 along the upper portions of the rear edges 130. The recesses 136 are designed to be aligned with the through holes 80 formed in the fork side tines 50,52 and, in their demounted position shown in FIG. 3, receive a pair of connecting pins 138.

Figure 7:
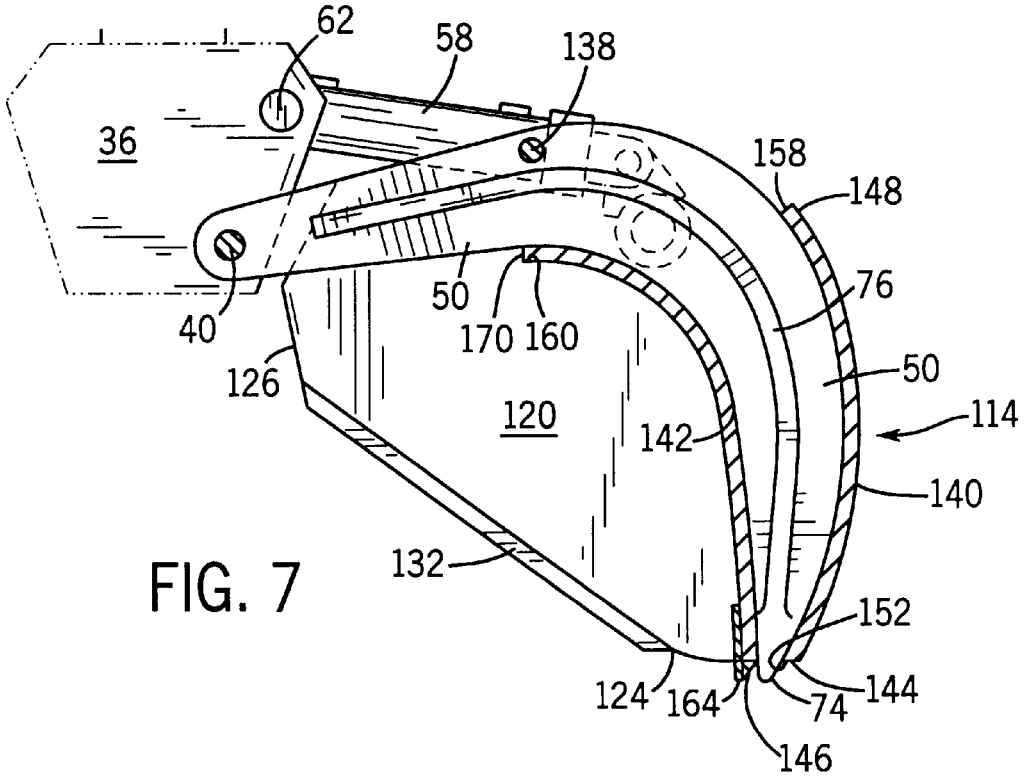
FIG. 7 is a partial sectional view of a fork side bucket installed on the grapple assembly.
Figure 8:
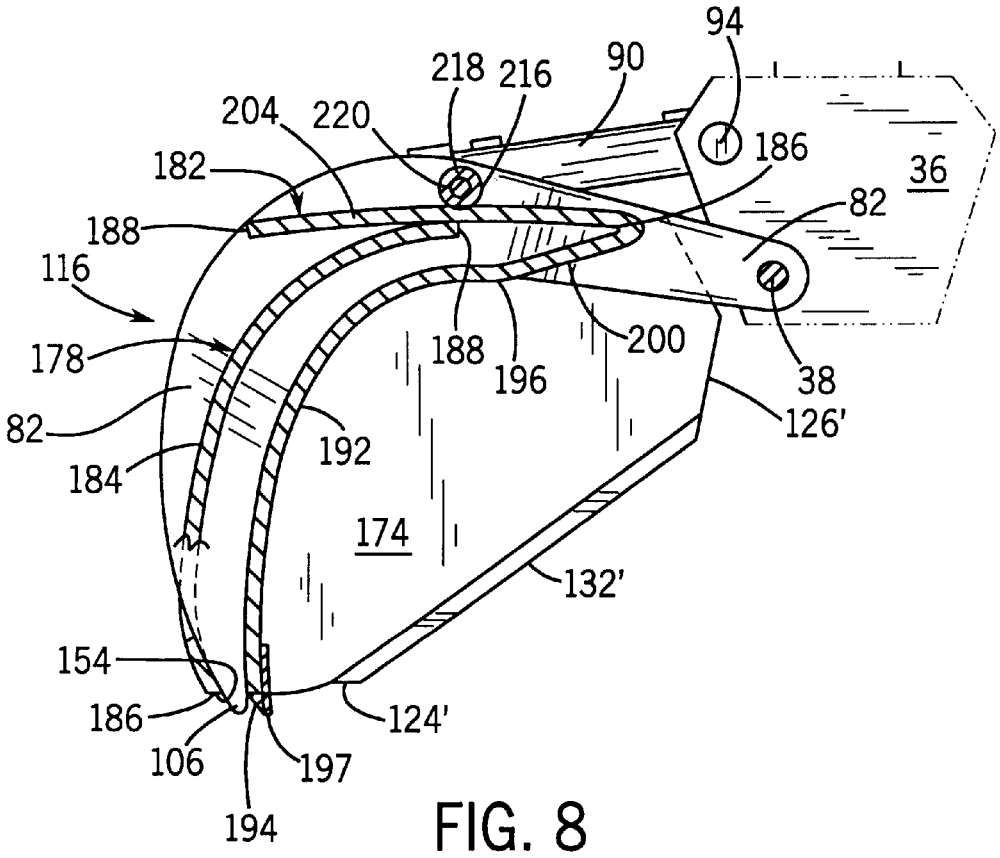
FIG. 8 is a partial sectional view of a clam side bucket installed on the grapple assembly.

In describing the structure of FIGS. 7 and 8 hereafter, it is noted that spatial references to forward, back, rearwardly, upwardly, downwardly, upright, upper and lower shall be based on and consistent with the illustrations of FIGS. 3, 5 and 6, which show buckets 114,116 resting on the ground.

Referring to FIGS. 6 and 7, fork side intermediate structure 122 of fork side bucket 114 includes an arcuate bottom wall 140 and an arcuate top wall 142, both of which are integrally formed together along respective linear forward edges 144,146. Bottom wall 140 extends between side plates 118,120 and runs rearwardly, downwardly and upwardly from the bottom of the front edge 124 partially along the curvature of the side plate rear edges 130. Bottom wall 140 has its forwardmost end formed with a pair of spaced openings 152 (only one of which is shown in FIG. 7) for receiving the tips 74 of the fork side tines 50,52. Bottom wall 140 also has a linear back edge 148 and a pair of opposed side edges 150 which are joined to the inside surfaces of side plates 118,120.

Arcuate top wall 142 extends between side plates 118,120 and runs rearwardly and upwardly from the bottom of the angled front edges 124 in spaced relationship from arcuate bottom wall 140. Besides linear forward edge 146, top wall 142 has a linear back edge 160 located above bottom wall back edge 148, and a pair of opposed side edges 162 which are fixed to the inside surfaces of the side plates 118,120. Top wall 142 presents a solid surface which forms a base of the bucket when particulate matter such as dirt is introduced thereto. Respective forward edges 144,146 of bottom and top walls 140,142 are secured together in a juncture which receives a forward projecting cutting edge 164 used to penetrate a mass of particulate matter to be scooped.

Clam side bucket 116 includes a pair of parallel, opposed side plates 172,174 interconnected together in one piece by a clam side intermediate structure 176. Because the clam side plates 172,174 have correspondingly similar structure as described above relative to the fork side side plates 118,120 and are substantially mirror images thereof, no further description is necessary and primed reference numerals are used to denote similar surfaces.

Referring to FIGS. 5 and 8, it can be seen that clam side intermediate structure 176 includes an arcuate bottom wall 178, an arcuate top wall 180, and a generally vertical back wall 182, each of which is centrally relieved to receive clam side jaw 48 therebetween. Each bottom wall 178 has a pair of spaced apart side sections 184 (only one of which is seen in FIG. 5), which extend inwardly from the inside surfaces of the side plates 172,174. Side sections 184 run rearwardly, downwardly and upwardly from the bottom of front edges 124' partially along an arcuate path spaced above the curvature of the side plate rear edges 130'. Bottom wall 178 has its forwardmost end formed with a pair of spaced openings 154 (only one of which is seen in FIG. 8) for receiving the tips 106 of clam side tines 82,84. Each bottom wall section 184 has a linear forward edge 186, terminates in a linear back edge 188 and includes an outside edge (not shown) which is joined to an inside surface of side plate 172,174. An inside edge 190 is adapted to guideably engage an outer side of one of the clam side tines 82,84.

Top wall 180 extends between side plates 172, 174 and has a planar central portion 192 which runs rearwardly and upwardly from the bottom of front edges 124' in spaced relationship from the arcuate bottom wall 178. Central portion 192 has a linear forward edge 194 which is joined to linear forward edges 186 on bottom wall side sections 184, and terminates in a linear back edge 196. Forward edges 186,194 are provided with a cutting edge 197. Central portion 192 defines a particulate material engaging base of clam side bucket 116. Top wall 180 also has a pair of lateral portions 200 (only one of which is seen in FIG. 5) which extend rearwardly from the inside surfaces of the side plates 172,174 and rise upwardly and rearwardly relative to central portion 192. Each lateral portion 200 presents another inside edge 202 which is generally aligned with the inside edge 190 of its corresponding bottom wall section 184. In addition, each lateral portion 200 has an outside edge (not shown) which is joined to an inside surface of side plate 172,174.

Back wall 182 is centrally recessed and includes a pair of spaced apart flanking portions 204,205 which extend inwardly from side plates 172,174 and descend from top edges 206 joined to lateral portion edges 202 to a transverse bottom edge 208 which connects the flanking portions 204,205. Similar to the bottom and top walls 178,180 respectively, each flanking portion 204,105 is provided with an inside edge 210 which is generally aligned with inside edges 190 and 202. Each flanking portion 204,205 also has an outside edge (not shown) joined to an inside surface of one of the side plates 172,174. Each back edge 188 of bottom wall section 184 is welded to a medial location 216 on a forward face of flanking portion 204,205. The rearward face of each flanking portion 204,205 carries a horizontally disposed cylindrical tube 218. Each tube 218 provides an opening which is aligned with side plate recess 136' and loosely receives and holds a headed connecting pin 220, the opening and recess 136' being alignable with appropriate through holes 108 in the clam side tines 82,84.

In use, when it is desired to convert grapple assembly 10 to a bucket attachment 12, buckets 114,116 are positioned as shown in FIG. 3, in opposite facing relationship, and with cutting edges 164,197 spaced apart and arcuate rear edges 130,130' on the ground of the working site. Connecting pins 138,220 are removed from being loosely held in both the buckets 114,116. Extension of hydraulic cylinders 58,90 will cause fork side and clam side jaws 46,48 to move together downwardly about pivot pins 42,44 in the direction of arrows shown in FIGS. 3, 5 and 6. With respect to fork side bucket 114, the outermost surfaces of the reinforcing bars 76 will slide against the inside surfaces of side plates 118,120, thereby keeping the fork side tines 50,52 spaced therefrom as depicted in FIG. 4. Fork side tines 50,52 continue to be continuously guided until only the tine tips 74 pass through openings 152 and further sliding motion of the tines 50,52 is stopped by the surrounding walls thereof, at which time the through holes 80 in the fork side tines 50,52 are aligned with the recesses 136 formed in the fork side bucket side plates 118,120. Thus, it can be appreciated that the bottom wall 140 and top wall 142 form a cavity to encase the lower half of the fork side tines 50,52. Connecting pins 138 are then manually inserted with pin heads disposed against the outer surfaces of bucket side plates 180,120 and the apertured pin ends extending beyond the inside surfaces of the fork side tines 50,52. Thereafter cotter pins, or other suitable retaining pins 222, are placed in the apertured ends to quickly and positively lock the fork side bucket 114 on the fork side jaw 46.

With respect to the clam side bucket 116, the outermost surfaces of the clam side tines 82,84 engage the respective inside surfaces 190, 202, 210 of bottom wall 178, top wall 180 and back wall 182. Clam side tines 82,84 pass between top wall 180 and bottom edge 208 until the tine tips 106 pass through openings 154 and further sliding motion of the tines 82,84 is stopped by the surrounding walls thereof. Here the through holes 108 of clam side tines 82,84 will be aligned with the cylindrical tube opening on back wall flanking portions 204,205 and the recesses 136' in clam side plates 172,174. At this point, headed connecting pins 220 are slidably inserted through the aligned through holes 108, recesses 136' and openings of tubes 218, and retained with suitable pins 222.

The entire installation process can be accomplished in several minutes without he use of any special tools and using the existing motion control of the grapple assembly 10. this means the buckets 114,116 can be moved toward and away from each other, as well as being rotated together for instance in the closed position of FIG. 2. When the connecting pins 138,220 are secured in place, each bucket 114,116 is restrained from moving forwardly or rearwardly relative to its particular jaw. It should be appreciated that the buckets 114,116 cannot shift appreciably back and forth relative to the grapple assembly 10 on which they are installed. The bucket attachment 12 may be retrofit to an existing assembly simply by adding respective through holes 80,108 in the proper location in the tines 50,52,82,84.

Referring to FIG. 1, with the bucket attachment 12 installed as described above, the hydraulic cylinders 58,90 may first be retracted so as to place the bucket attachment 12 in an open position. With subsequent extension of the hydraulic cylinders 58,90, the cutting edges 164,197 can dig into dirt, gravel, sand, wood chips or the like moving to a closed position shown FIG. 2 in which particulate matter is retained by the inner bucket structure, the cooperating cutting edges 164 and 197, and edges of straps 132,132'. It is to be noted that the bucket attachment 12 is not necessarily limited to digging, collecting, holding and transferring particulate material. For example, the bucket attachment 12 may be used to pick up and relocate bunches of tree branches, small boulders, or the like. To remove the bucket attachment 12 from the grapple assembly 10, the buckets 114,116 are emptied and from their FIG. 2 position, the hydraulic cylinders 58,90 are extended so as to roll the buckets 114,116 back to their FIG. 1 position. The connecting pins 138,220 are then removed and the cylinders 58,90 are retracted so as to easily slip and disengage the jaws 46,48 away from the buckets 114,116.

Figure 9:
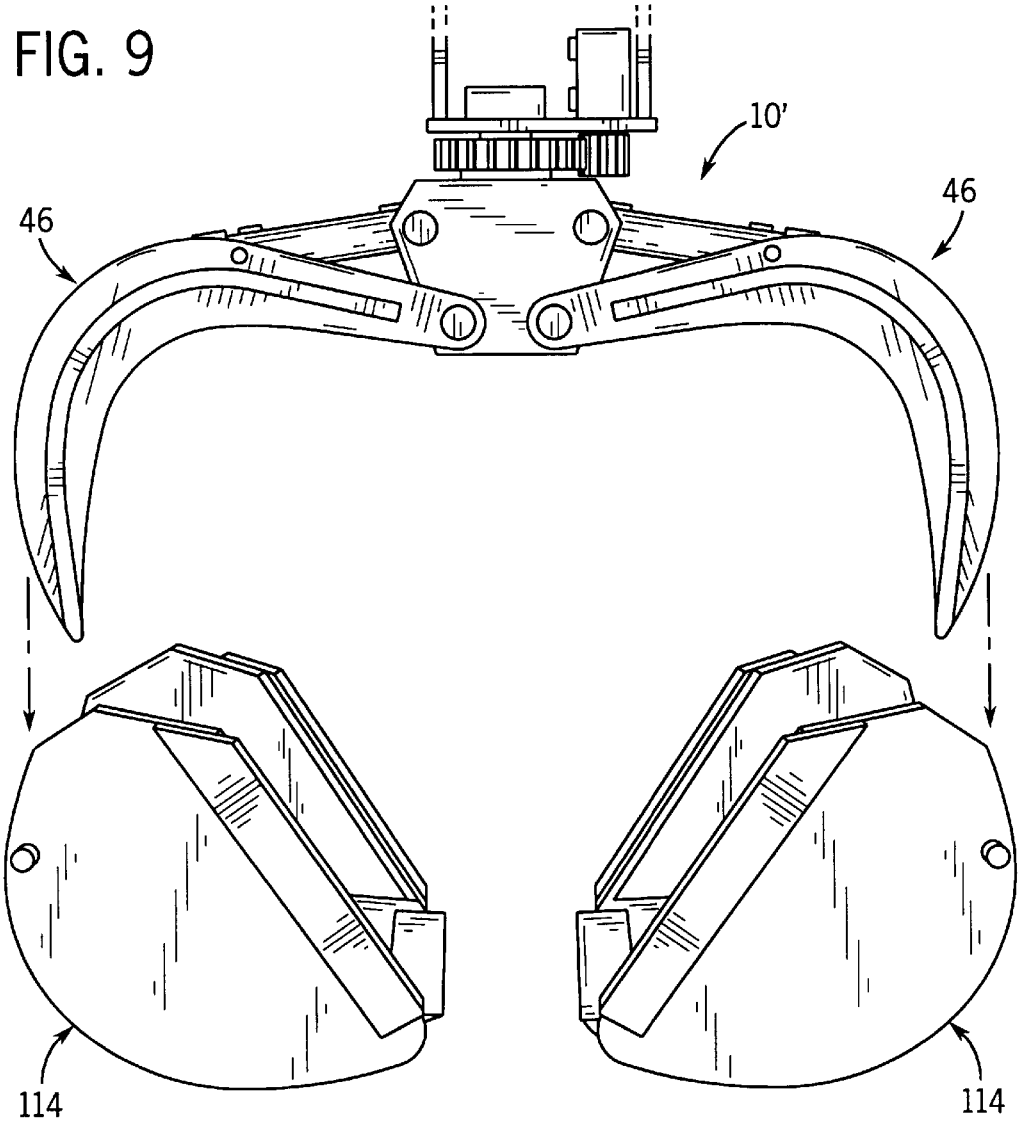
FIG. 9 is a view similar to FIG. 3 showing the bucket arrangement to be arranged on a butt-type grapple assembly employing a pair of fork side jaws and buckets.
Figure 10:
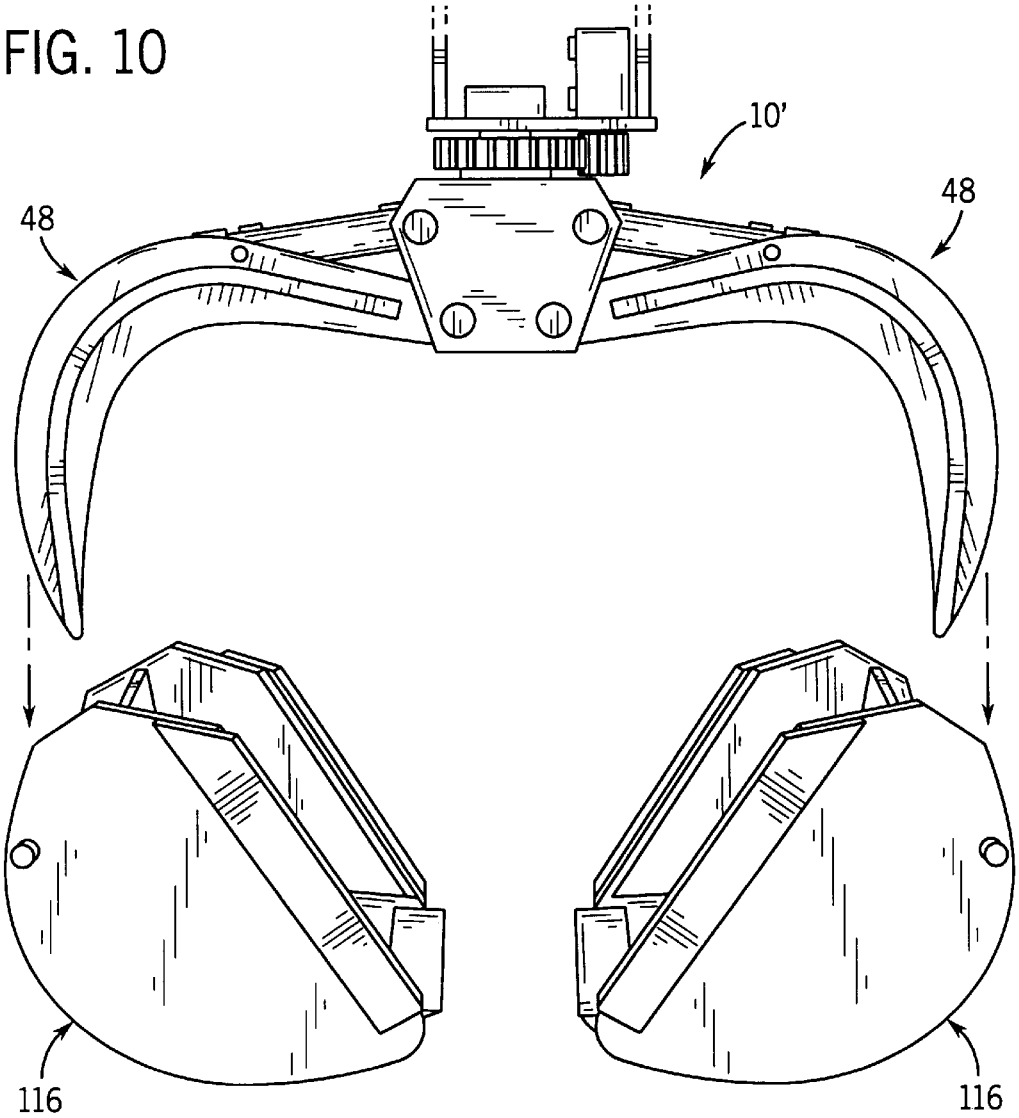
FIG. 10 is a view similar to FIG. 3 showing the bucket arrangement to be arranged on a butt-type grapple assembly employing a pair of clam side jaws and buckets.

While the present invention has been described for use with bypass-type grapple assembly 10, it can also be utilized, as shown in FIGS. 9 and 10, with a butt-type grapple 10' useful in handling smaller pieces of wood and pulp. Instead of employing a fork side jaw 46 and a clam side jaw 48, the butt-type grapple 10' uses a pair of fork side jaws 46 (FIG. 9) or a pair of clam side jaws 48 (FIG. 10). In these versions, a grapple 10' with a pair of fork side jaws 46 is provided with a pair of slip-on fork side buckets 114, while a grapple 10' with a pair of clam side jaws 48 is provided with a pair of slip-on clam side buckets 116. The structure, installation and removal of the buckets 114 or 116 relative to their respective jaws 46 or 48 is exactly as previously described. It should be appreciated that a grapple 10' constructed with fork side jaws 46 and buckets 114 is easier to make, requiring less material and time than a grapple 10' produced with clam side jaws 48 and buckets 116. However, the latter version, by virtue of its wider design, offers greater carrying capacity for dirt or other material.

Various alternatives and embodiments are contemplated as being within the scope of the following claims particularly pointing out and distinctly claiming the subject matter regarded as the invention.

I claim:

1. A bucket attachable to a tined jaw of a grapple on the boom of a mobile machine, the bucket comprising:

a pair of opposed, parallel side plates, each of the side plates having a linear front edge, a linear top edge and an arcuate rear edge having a recess formed therethrough;

intermediate structure interconnecting the side plates and including an arcuate top wall running rearwardly and upwardly along a curved path spaced from the rear edge from a linear forward edge commencing beneath the front edge to a linear back edge, the top wall being constructed and arranged to extend over upper and lower portions of the jaw; and a pair of connecting pins, each of which is receivable in one of the side plate recesses and a through hole formed in an upper portion of the jaw.

2. The bucket of claim 1, wherein the side plates are generally coextensive with each other.

3. The bucket of claim 1, wherein the top wall is configured to correspond to the shape of the jaw.

4. The bucket of claim 1, wherein the linear forward edge is provided with a cutting edge used to penetrate particulate matter.

5. The bucket of claim 1, wherein the intermediate structure enables centering of the jaw between the side plates.

6. An implement attachable to a boom structure of a mobile machine comprising:

a grapple assembly having a fork side jaw and a clam side jaw pivotably mounted on parallel axes, each jaw having a pair of parallel, spaced apart tines formed with curved upper and lower surfaces;

a bucket attachment removably secured on the jaws, the bucket attachment including;

a fork side bucket having a pair of opposed end plates with arcuate rear edges, the end plates being interconnected by a fork side intermediate structure provided with an arcuate bottom wall and an arcuate top wall, both of which are integrally formed together along respective linear forward edges, the bottom wall running rearwardly, downwardly and upwardly partially along the curvature of the rear edge and terminating in a linear back edge, the top wall running rearwardly and upwardly in spaced relationship to the bottom wall and terminating in a linear back edge above the bottom wall back edge, the bottom wall and the top wall forming a cavity encasing the lower half of the fork side tines;

a clam side bucket having a pair of opposed end plates with arcuate rear edges, the end plates being connected by a clam side intermediate structure provided with an arcuate bottom wall, an arcuate top wall and a generally upright back wall, the end plates being connected by a clam side intermediate structure provided with an arcuate bottom wall, an arcuate top wall and a generally upright back wall, each being centrally relieved to receive the clam side tines therebetween, the bottom wall having spaced apart, side sections extending inwardly from inside surfaces of the side plates, each side section running rearwardly, downwardly and upwardly along an arcuate path spaced above rear edges from a linear forward edge to a linear back edge, the top wall having a central planar section running rearwardly and upwardly from a linear forward edge joined to linear forward edges of bottom wall side sections and terminating in a linear back edge, the back wall having spaced apart flanking portions extending inwardly from inside surfaces of side plates, and a bottom edge interconnecting the flanking portions, each of the bottom wall, top wall and back wall defining inside edges for guiding outer sides of the clam side tines; and a connector arrangement for coupling each fork side and clam side bucket side wall to a respective fork side and clam side tine.

7. The implement of claim 6, wherein the spacing between the clam side tines is less than the spacing between the fork side tines.

8. The implement of claim 6, wherein the fork side intermediate structure and the clam side intermediate structure cooperate to enable their respective buckets to close upon each other to hold particulate material therein.

9. An implement attachable to a boom structure of a mobile machine comprising:

a grapple assembly having a pair of fork side jaws pivotably mounted on parallel axes, each jaw having a pair of parallel, spaced apart tines formed with curved upper and lower surfaces;

a bucket attachment removably secured on the jaws, the bucket attachment including;

a pair of fork side buckets, each bucket having a pair of opposed end plate with arcuate rear edges, the end plates being interconnected by a fork side intermediate structure provided with an arcuate bottom wall and an arcuate top wall, both of which are integrally formed together along respective linear forward edges, the bottom wall running rearwardly, downwardly and upwardly partially along the curvature of the rear edge and terminating in a linear back edge, the top wall running rearwardly and upwardly in spaced relationship to the bottom wall and terminating in a linear back edge above the bottom wall back edge, the bottom wall and the top wall forming a cavity encasing the lower half of the fork side tines; and a connector arrangement for coupling each fork side bucket side wall for a respective fork side tine.

10. An implement attachable to a boom structure of a mobile machine comprising:

a grapple assembly having a pair of clam side jaws pivotably mounted on parallel axes, each jaw having a pair of parallel, spaced apart tines formed with curved upper and lower surfaces;

a bucket attachment removably secured on the jaws, the bucket attachment including;

a pair of clam side buckets, each bucket having a pair of opposed end plates with arcuate rear edges, the end plates being connected by a clam side intermediate structure provided with an arcuate bottom wall, an arcuate top wall and a generally upright back wall, the end plates being connected by a clam side intermediate structure provided with an arcuate bottom wall, an arcuate top wall and a generally upright back wall, each being centrally relieved to receive the clam side tines therebetween, the bottom wall having spaced apart, side sections extending inwardly from inside surfaces of the side plates, each side section running rearwardly, downwardly and upwardly along an arcuate path spaced above rear edges from a linear forward edge to a linear back edge, the top wall having a central planar section running rearwardly and upwardly from a linear forward edge joined to linear forward edges of bottom wall side sections and terminating in a linear back edge, the back wall having spaced apart flanking portions extending inwardly from inside surfaces of side plates, and a bottom edge interconnecting the flanking portions, each of the bottom wall, top wall and back wall defining inside edges for guiding outer sides of the clam side tines; and a connector arrangement for coupling each clam side bucket side wall to a respective clam side tine.

* * * * *